US006886535B2

(12) United States Patent
Boehland

(10) Patent No.: US 6,886,535 B2
(45) Date of Patent: May 3, 2005

(54) FUEL-INJECTION DEVICE FOR AN INTERNAL COMBUSTION ENGINE

(75) Inventor: Peter Boehland, Marbach (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/475,246

(22) PCT Filed: Dec. 6, 2002

(86) PCT No.: PCT/DE02/04479

§ 371 (c)(1),
(2), (4) Date: Apr. 28, 2004

(87) PCT Pub. No.: WO03/071124

PCT Pub. Date: Aug. 28, 2003

(65) Prior Publication Data

US 2004/0182951 A1 Sep. 23, 2004

(30) Foreign Application Priority Data

Feb. 20, 2002 (DE) ..... 102 07 045

(51) Int. Cl.[7] ..... F02M 55/00
(52) U.S. Cl. ..... 123/446; 123/447
(58) Field of Search ..... 123/446, 447, 123/506

(56) References Cited

U.S. PATENT DOCUMENTS 3,847,510 A * 11/1974 Fenne ..... 417/293
4,784,101 A * 11/1988 Iwanaga et al. ..... 123/446
5,709,341 A * 1/1998 Graves ..... 239/92
6,021,760 A * 2/2000 Boecking ..... 123/467
6,267,306 B1 * 7/2001 Phillips et al. ..... 239/585.1

FOREIGN PATENT DOCUMENTS

EP 0 987 431 A 3/2000

* cited by examiner

*Primary Examiner*—Thomas Moulis
(74) *Attorney, Agent, or Firm*—Ronald E. Greigg

(57) ABSTRACT

The fuel injection apparatus has a high-pressure fuel pump and a fuel injection valve for each cylinder of the engine. The pump has at least one piston driven by the engine and delimiting a pump working chamber supplied with fuel from a fuel tank. A control valve at least indirectly controls a connection of the pump working chamber to a relief chamber and a pressure source in order to fill the pump working chamber during the intake stroke. The pump has a first pump piston inside which a second pump piston is guided approximately coaxially, with the two pistons delimiting the working chamber. The first piston is driven in a stroke motion, and the two pistons can optionally be coupled to move together as a unit during the delivery stroke, or the second piston can be fixed in a passive position so that only the first pump piston executes the delivery stroke.

20 Claims, 6 Drawing Sheets

FUEL-INJECTION DEVICE FOR AN INTERNAL COMBUSTION ENGINE

CROSS-REFERENCE TO RELATED APPLICATIONS

This application is a 35 USC 371 application of PCT/DE 02/04479 filed on Dec. 6, 2002.

BACKGROUND OF THE INVENTION

1. Field of the Invention

The invention is directed to an improved fuel injection apparatus for an internal combustion engine.

2. Description of the Prior Art

A fuel injection apparatus known from EP 0 987 431 A2 has a high-pressure fuel pump and a fuel injection valve connected to it for each cylinder of the internal combustion engine. The high-pressure fuel pump has a pump piston that delimits a pump working chamber and is driven into a stroke motion by the engine. The fuel injection valve has a pressure chamber connected to the pump working chamber and an injection valve element that controls at least one injection opening; the pressure prevailing in the pressure chamber can move the injection valve element in the opening direction counter to a closing force in order to open the at least one injection opening. A control valve controls a connection of the pump working chamber to a relief chamber and a pressure source. When the control valve is open, the pump working chamber is filled with fuel from the pressure source during the intake stroke of the pump piston. The object is for the high-pressure pump to produce a high pressure even at a low speed of the engine, thus achieving a high performance and a high torque of the engine. The pressure produced by the high-pressure pump, however, increases with the speed of the engine; the maximal pressure achieved must be limited in order to assure a sufficient service life of the high-pressure pump. With a given drive unit of the high-pressure pump and a given diameter of the pump piston, a design compromise must be struck in order on the one hand to achieve a sufficiently high pressure at a low speed and on the other hand, not to exceed the maximal pressure that has been predetermined for reasons related to the service life.

SUMMARY AND ADVANTAGES OF THE INVENTION

The fuel injection apparatus according to the invention has the advantage over the prior art that the pressure produced by the high-pressure pump can be limited by bringing the second pump piston into a passive position so that only the first pump piston continues to supply fuel. It is possible for the two pump pistons to be coupled to each other so that they execute a joint delivery stroke at a low engine speed, while at a high engine speed, the second pump piston is placed into its passive position so that only the first pump piston executes a delivery stroke, thus reducing the pressure produced. The first pump piston can be embodied with a diameter great enough that a high pressure is produced even at a low engine speed.

Advantageous embodiments and modifications of the fuel injection apparatus according to the invention are disclosed. One embodiment permits an advantageous placement of the second pump piston into its passive position, while another makes it possible for the pump piston to be easily manufactured. A further embodiment permits a pressure compensation between the pump working chamber and the chamber in the first pump piston in the event of a leak. It can assured that when the pump pistons are coupled to each other, no fuel can flow out of the pump working chamber via the through bore in the second pump piston, and a contact of the second pump piston against the extremity of the pump working chamber in the region of the inner dead center of the pump piston. One embodiment assures that when the second pump piston is disposed in its passive position during the delivery stroke of the first pump piston, no fuel can flow out of the pump working chamber via the through bore in the second pump piston, while another embodiment achieves a pressure compensation between the through bore in the second pump piston and the pump working chamber when in the vicinity of the inner dead center of the pump pistons. Another embodiment achieves a reliable contact of the second pump piston against the extremity, while still another achieves a simple placement of the second pump piston into its passive position.

BRIEF DESCRIPTION OF THE DRAWINGS

Other features and advantages of the invention will become apparent from the description contained herein below, taken in conjunction with the drawings, in which.

DESCRIPTION OF THE PREFERRED EMBODIMENT

Figure 1:
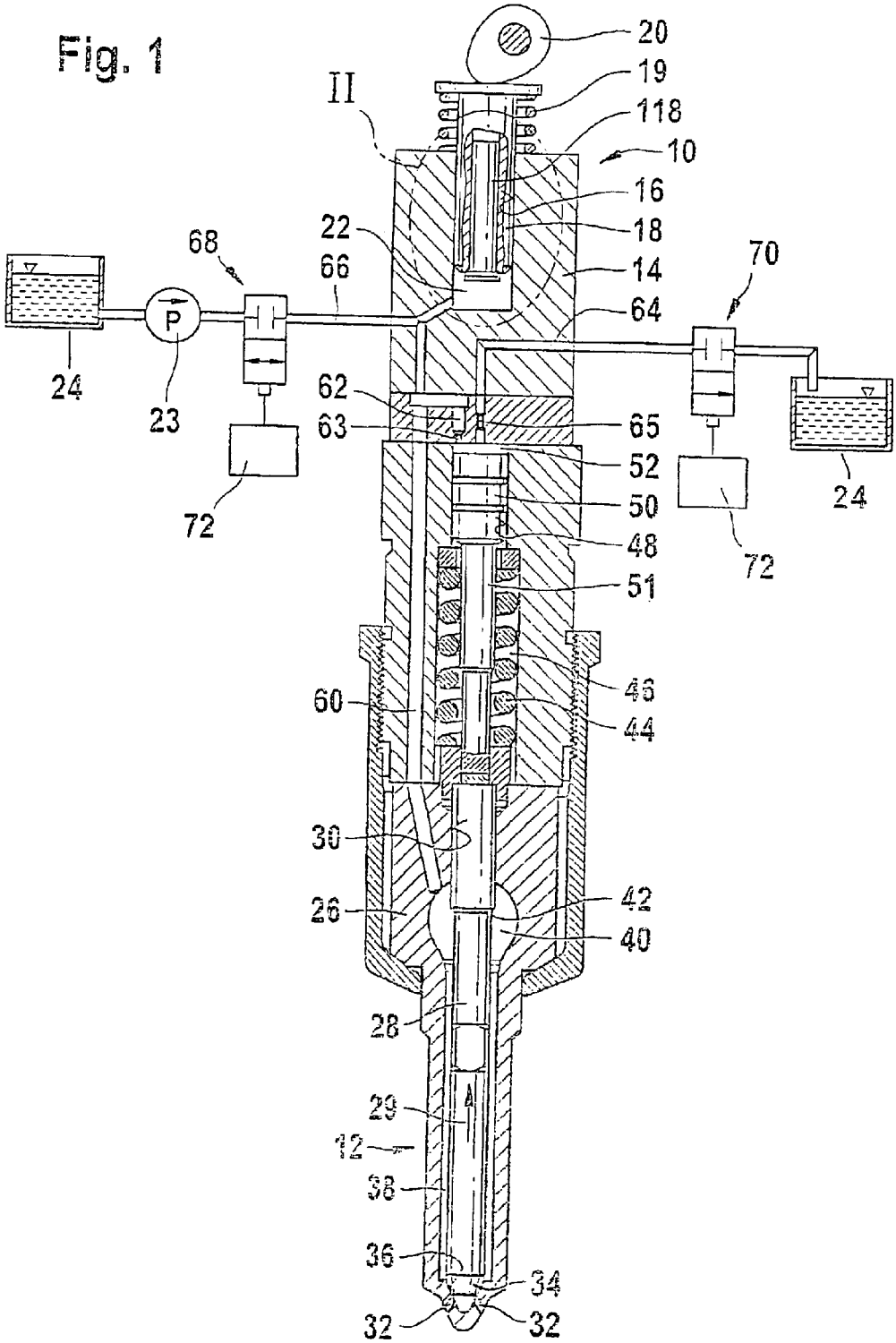
FIG. 1 shows a schematic, longitudinal section through a fuel injection apparatus embodying the invention to use in an internal combustion engine.

FIGS. 1 to 5 show a fuel injection apparatus for an internal combustion engine of a motor vehicle preferably an internal combustion engine with autoignition. The fuel injection apparatus is preferably embodied as a so-called unit fuel injector and, for each cylinder of the engine, has a high-pressure fuel pump 10 and a fuel injection valve 12 connected to it, which compromise a common component. Alternatively, the fuel injection apparatus can also be embodied as a so-called unit pump system, in which the high-pressure fuel pump and the fuel injection valve of each cylinder are disposed separately from each other and are connected to each other via a line. The high-pressure fuel pump 10 has a pump body 14 with a cylinder bore 16 that contains two pump pistons 18, 118, wherein a large diameter section of a first pump piston 18 is guided in a sealed fashion in the cylinder bore 16 and is set into a stroke motion counter the force of a return spring 19, at least indirectly by means of a cam 20 of a camshaft of the engine. A second pump piston 118 is disposed inside the first pump piston 18, at least approximately coaxial to it. The pump pistons 18, 118 will be explained in detail later. In the cylinder bore 16, the end surfaces of the two pump pistons 18, 118 delimit a pump working chamber 22 in which fuel is compressed at high pressure during the delivery stroke of the pump pistons 18, 118. The pump working chamber 22 is supplied with fuel from a fuel tank 24 of the motor vehicle by means of a pressure source, which is preferably a fuel-supply pump 23.

The fuel injection valve 12 has a valve body 26 that is connected to the pump body 14 and can be composed of a number of parts; an injection valve element 28 is guided in a longitudinally sliding fashion in a bore 30 in this valve body 26. The valve body 26 has at least one, preferably several injection openings 32 in its end region oriented toward the combustion chamber of the cylinder of the engine. The injection valve element 28 has a sealing surface 34 in its end region oriented toward the combustion chamber, which surface is approximately conical, for example, and cooperates with a valve seat 36 embodied in the end region of the valve body 26 oriented toward the combustion chamber; the injection openings 32 branch off from this valve seat 36 or branch off downstream of it. In the valve body 26, between the injection valve element 28 and the bore 30, toward the valve seat 36, there is an annular space 38 whose end region oriented away from the valve seat 36, by means of a radial enlargement of the bore 30, transitions into a pressure chamber 40 that encompasses the injection valve element 28. At the level of the pressure chamber 40, the injection valve element 28 has a pressure shoulder 42 formed by a cross sectional reduction. The end of the injection valve element 28 oriented away from the combustion chamber is engaged by a prestressed closing spring 44, which presses the injection valve element 28 toward the valve seat 36. The closing spring 44 is disposed in a spring chamber 46 of the valve body 26, adjoining the bore 30. It is possible for a second injection valve element, which controls at least one second injection opening, to be disposed so that it can slide at least approximately coaxially inside the injection valve element 28. When used, the at least one second injection opening is disposed offset from the at least one first injection opening 32, toward the combustion chamber in the direction of the longitudinal axis of the injection valve element 28. A second closing spring acts on the second injection valve element in the closing direction. In addition, the pressure prevailing in a pressure chamber acts at least indirectly on the second injection valve element in the closing direction. Consequently, by controlling the pressure in the pressure chamber, the closing force acting on the second injection valve element can be varied so that when the pressure is high and there is thus a powerful closing force on the second injection valve element, only the first injection valve element 28 opens and unblocks the at least one first injection opening 32 or, when the pressure in the pressure chamber is low and there is thus a weaker closing force acting on the second injection valve element, both the first and second injection valve elements are opened, thus also unblocking the at least one second injection opening.

At its end oriented away from the bore 30, the spring chamber 46 can be adjoined by an additional bore 48 in the valve body 26, in which a control piston 50 is guided in a sealed fashion, which piston is connected to the injection valve element 28. In the bore 48, the end surface of the control piston 50 functions as a moving wall that delimits a control pressure chamber 52. The control piston 50 is connected to the injection valve element 28 by means of a piston rod 51 whose diameter is smaller than that of the control piston. The control piston 50 can be of one piece with the injection valve element 28, but for assembly reasons, is preferably embodied as a separate part that is attached to the injection valve element 28.

A conduit 60 leads from the pump working chamber 22, through the pump body 14 and the valve body 26, to the pressure chamber 40 of the fuel injection valve 12. A conduit 62 leads from the pump working chamber 22 or the conduit 60 to the control pressure chamber 52. The control pressure chamber 52 is also fed by a conduit 64, which produces a connection to a relief chamber, which function can be served at least indirectly by the fuel tank 24 or another region in which a low pressure prevails. A connection 60 leads from the pump working chamber 22 or the conduit 60 to a relief chamber, which function can be served, for example, at least indirectly by the fuel tank 24 or the pressure side of the fuel-supply pump 23, and then on to the fuel-supply pump 23. The connection 66 is controlled by means of a first electrically actuated control valve 68. The control valve 68 can be embodied as a 2/2-port directional-control valve. The connection 64 of the control pressure chamber 52 to the relief chamber 24 is controlled by a second electrically actuated control valve 70, which can be embodied as a 2/2-port directional-control valve. A throttle restriction 63 is provided in the connection 62 of the control pressure chamber 52 to the pump working chamber 22 and a throttle restriction 65 is provided in the connection of the control pressure chamber 52 to the relief chamber. The supply of fuel from the pump working chamber 22 into the control pressure chamber 52 and the outflow of fuel from the control pressure chamber 52 can be set to the necessary levels through suitable dimensioning of the throttle restrictions 63, 65. A sufficient supply of fuel to the control pressure chamber 52 is necessary for a rapid closing of the fuel injection valve 12 and a sufficient outflow of fuel from the control pressure chamber 52 is necessary for a rapid opening of the fuel injection valve 12. The control valves 68, 70 can have an electromagnetic actuator or a piezoelectric actuator and are triggered by an electronic control unit 72.

The design of the high-pressure fuel pump 10 with the two pump pistons 18, 118 will be explained in detail below in conjunction with FIGS. 2 to 5. The first pump piston 18 has a blind bore 80 that extends inside it, at least approximate coaxial to it, which opens toward the end surface of the pump piston 18 that delimits the pump working chamber 22. The mouth of the blind bore 80 on the end surface of the first pump piston 18 has a for example at least approximately conical bevel 81 that increases the diameter of the blind bore 80. Close to the bottom 82 of the blind bore 80, the first pump piston 18 has a lateral bore 83, that connects the blind bore 80 to a groove 84 extending in the longitudinal direction that is let into the outer casing of the pump piston 18. Starting from the lateral bore 83, the longitudinal groove 84 extends both toward the pump working chamber 22 and away from it. In a middle region of its longitudinal span, the first pump piston 18 also has another lateral bore 85, which connects the blind bore 80 another longitudinal groove 86 let into the outer casing of the pump piston 18. The longitudinal groove 86 extends from the lateral bore 85 toward the pump working chamber 22. The cylinder bore 16 is provided with a lateral bore 87, which is connected to a low-pressure region and remains in communication with the longitudinal groove 84 of the first pump piston 18 over the entire stroke of the pump piston 18. For example, an at least approximately atmospheric pressure prevails in the low-pressure region. In its end region, in which the pump working chamber 22 is disposed, the cylinder bore 16 has a section 116 with a slightly greater diameter than in the remaining region in which it guides the first pump piston 18 in a sealed fashion. The cylinder bore 16 and therefore the pump working chamber 22 formed in it has an extremity 17 that extends at least approximately perpendicular to the longitudinal axis of the first pump piston 18 and is disposed opposite from the end surface of the pump piston 18 that delimits the pump working chamber 22.

The second pump piston 118 is guided so that it can slide inside the blind bore 80 of the first pump piston 18 and protrudes from the blind bore 80 with its end that delimits the pump working chamber 22. At its end protruding from the blind bore 80, the second pump piston 118 has an enlarged-diameter section 150 on which an annular shoulder 151 is formed, which is oriented toward the first pump piston 18. The second pump piston 118 has a through conduit 180 extending in its longitudinal direction, which can be embodied as a through bore and extends from the end surface delimiting the pump working chamber 22 to the end surface of the second pump piston 118 oriented toward the bottom 82 of the blind bore 80 in the first pump piston 18. A throttle restriction 181 is provided in the through bore 180 of the second pump piston 118. The end surface of the second pump piston 118 oriented toward the extremity 17 of the pump working chamber 22 is conically beveled in such a way that it is recessed in the radially inward direction toward the mouth of the through bore 180. This produces an annular edge on the radially outer rim of the second pump piston 118, which constitutes a sealing surface 152.

At its end disposed in the blind bore 80, the second pump piston 118 has a diametrically reduced section 154. At the transition of the second pump piston 118 from its full diameter to its section 154, an annular shoulder 155 is formed, which is oriented toward the bottom 82 of the blind bore 80. The second pump piston 118 delimits a chamber 153 in the blind bore 80 and the lateral bore 83 in the first pump piston 18 connects this chamber to the low-pressure region. The end surface of the second pump piston 118 oriented toward the bottom 82 of the blind bore 80 is conically beveled in such a way that it is recessed in the radially inward direction toward the mouth of the through bore 180. This produces an annular edge on the radially outer rim of the end surface of the second pump piston 118, which constitutes a sealing surface 156. A spring 158, which is embodied for example as a helical compression spring encompassing the section 154 of the second pump piston 118, is clamped between the bottom 82 of the blind bore 80 and the annular shoulder 155 of the second pump piston 118. In a middle region of the second pump piston 118, viewed in its longitudinal direction, a lateral bore 160 is provided, which connects the through bore 180 to an annular groove 161 let into the outer casing of the second pump piston 118. The second pump piston 118 is guided inside the blind bore 80 in a sealed fashion and with little play, at least in its region between the lateral bore 160 and the section 150 protruding from the blind bore 80 of the first pump piston 18. Preferably, the second pump piston 118 is also guided in a sealed fashion and with little play in a part of that region of the blind bore 80 between the lateral bore 160 and the annular shoulder 155.

Figure 2:
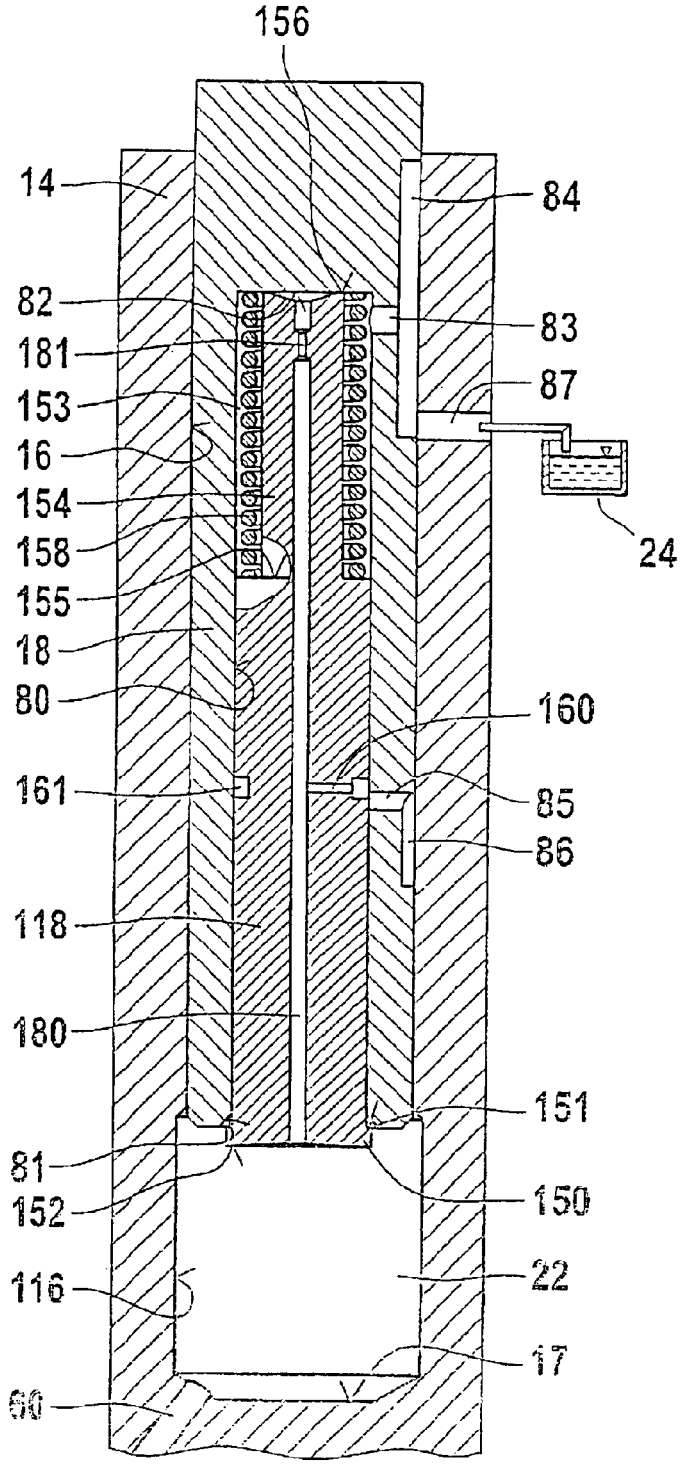
FIG. 2 shows an enlarged detail, labeled II in FIG. 1, of the fuel injection apparatus, with two pump pistons coupled to each other, disposed at an outer dead center.
Figure 3:
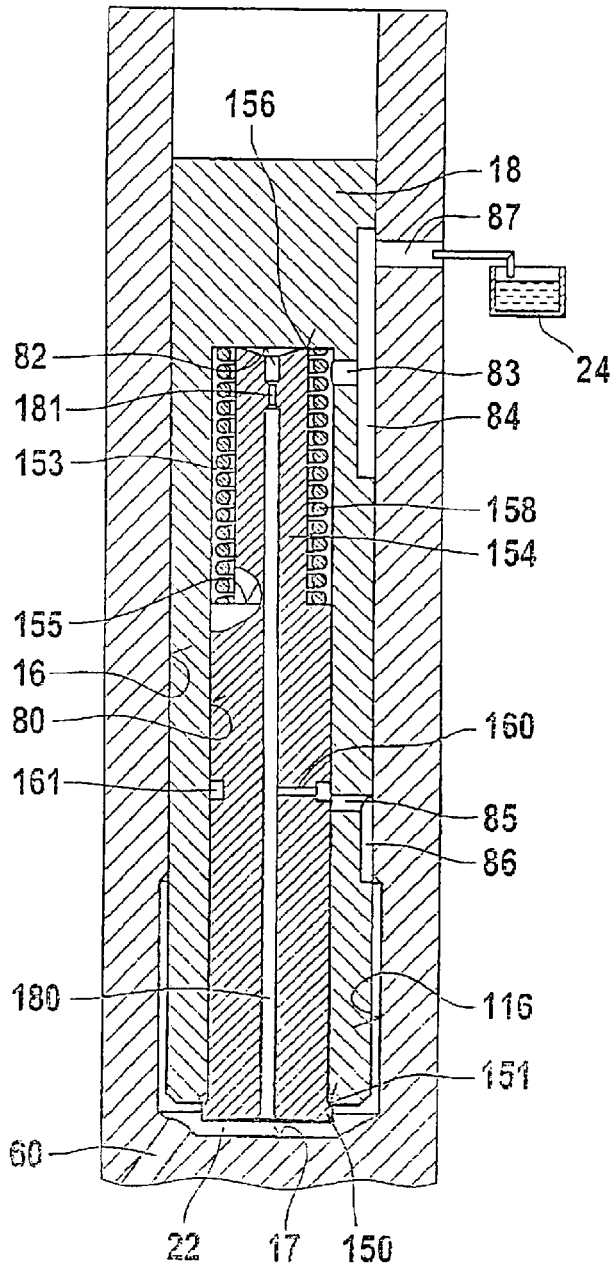
FIG. 3 shows the detail II with the pump pistons at an inner dead center.

In the high-pressure fuel pump 10, it is optionally possible for the two pump pistons 18, 118 to be coupled to each other and execute a delivery stroke as a unit. During the delivery stroke, the pump pistons 18, 118 move starting from an outer dead center, in which they protrude the furthest out from the cylinder bore 16, as shown in FIG. 2, to an inner dead center in which they are inserted the furthest into the cylinder bore 16, as shown in FIG. 3. If the two pump pistons 18, 118 are coupled to each other, then the second pump piston 118 is inserted into the blind bore 80 of the first pump piston 18 until it rests with its sealing surface 156 against the bottom 82 of the blind bore 80, as shown in FIGS. 2 and 3. In this position of the second pump piston 118, its annular groove 161 coincides with the lateral bore 85 of the first pump piston 18 and the spring 158 is compressed to its shortest length. The pressure prevailing in the pump working chamber 22 acts on the end surface of the second pump piston 118 and generates a compressive force acting on it, which presses the sealing surface 156 of the second pump piston 118 against the bottom 82 of the blind bore 80, counter to the force of the spring 158 and counter to the low pressure prevailing in the chamber 153. As a result, the sealing surface 156 disconnects the through bore 180 of the second pump piston 118 from the chamber 153 and therefore from the low-pressure region so that fuel cannot flow out of the pump working chamber 22 via the through bore 180. In the event of a leak between the sealing surface 156 and the bottom 82, though, a small quantity of fuel can flow via the through bore 180 in the second pump piston 118, into the chamber 153, and into the low-pressure region, but the throttle restriction 181 limits this flow. During the delivery stroke of the pump pistons 18, 118, the entire end surface of the pump piston, i.e. the annular end surface of the first pump piston 18 and the end surface of the second pump piston 118 disposed inside it contribute to the production of pressure in the pump working chamber 22 so that a high pressure is produced in the pump working chamber 22. The pump pistons 18, 118 produce a high pressure in the pump working chamber 22 as long as the first control valve 68 is closed and the pump working chamber 22 is disconnected from the relief chamber 24 and the fuel-supply pump 23.

If the pump pistons 18, 118 are disposed in the region of their inner dead center, as shown in FIG. 3, then the longitudinal groove 86 of the first pump piston 18 is inserted into the section 116 of the cylinder bore 16 so that the through bore 180 in the second pump piston 118 is connected to the pump working chamber 22 via the longitudinal groove 86 and the lateral bore 85 in the first pump piston 18 and via the annular groove 161 and the lateral bore 160 in the second pump piston 118. In the subsequent intake stroke of the pump pistons 18, 118, they move away from their inner dead center toward their outer dead center. The first control valve 68 is opened here so that fuel flows into the pump working chamber 22 at the pressure produced by the fuel-supply pump 23. Depending on the speed the engine and therefore the speed at which the pump pistons 18, 118 move during the intake stroke starting from their inner dead center, the pressure in the pump working chamber 22 drops in relation to the pressure produced by the fuel-supply pump 23, down to a pressure that is lower than the fuel-supply pump pressure. During its intake stroke, the first pump piston 18, induced by the force of the return spring 19, moves at a predetermined speed that is a function of the shape of the cam 20. During the intake stroke, the second pump piston 118, induced by the pressure in the pump working chamber 22 acting on its end surface, also moves away from its inner dead center when the force exerted on the second pump piston 118 by the pressure prevailing in the pump working chamber 22 is greater than the counteracting force, which is equal to the sum of the force of the spring 158 and the force exerted on the second pump piston 118 by the low pressure prevailing in the chamber 153. During the intake stroke, the second pump piston 118 moves away from the inner dead center and no later than when it reaches the outer dead center, its sealing surface 156 comes into contact with the bottom 82 of the blind bore 80 in the first pump piston 18. During the subsequent delivery stroke, the pump pistons 18, 118 then once again move inward as a unit, traveling toward their inner dead center.

Figure 4:
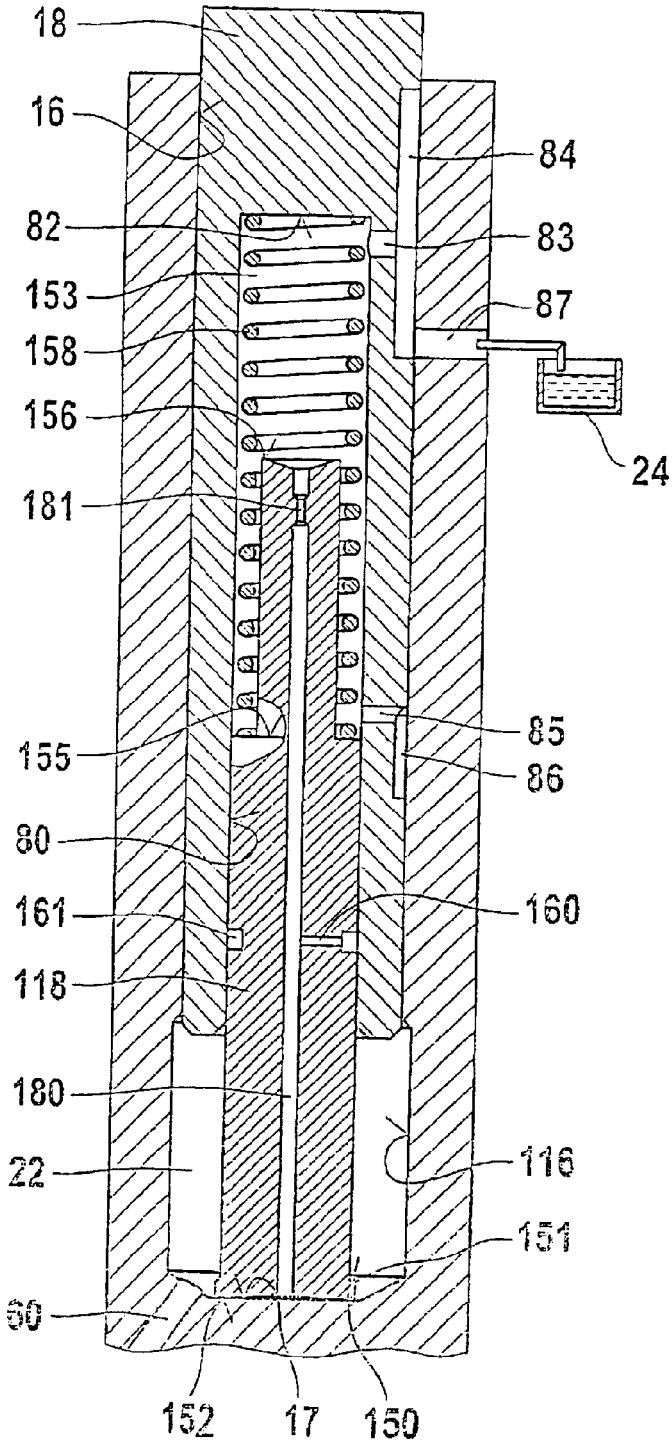
FIG. 4 shows the detail II with the one pump piston disposed in a passive position and one pump piston disposed at an outer dead center.
Figure 5:
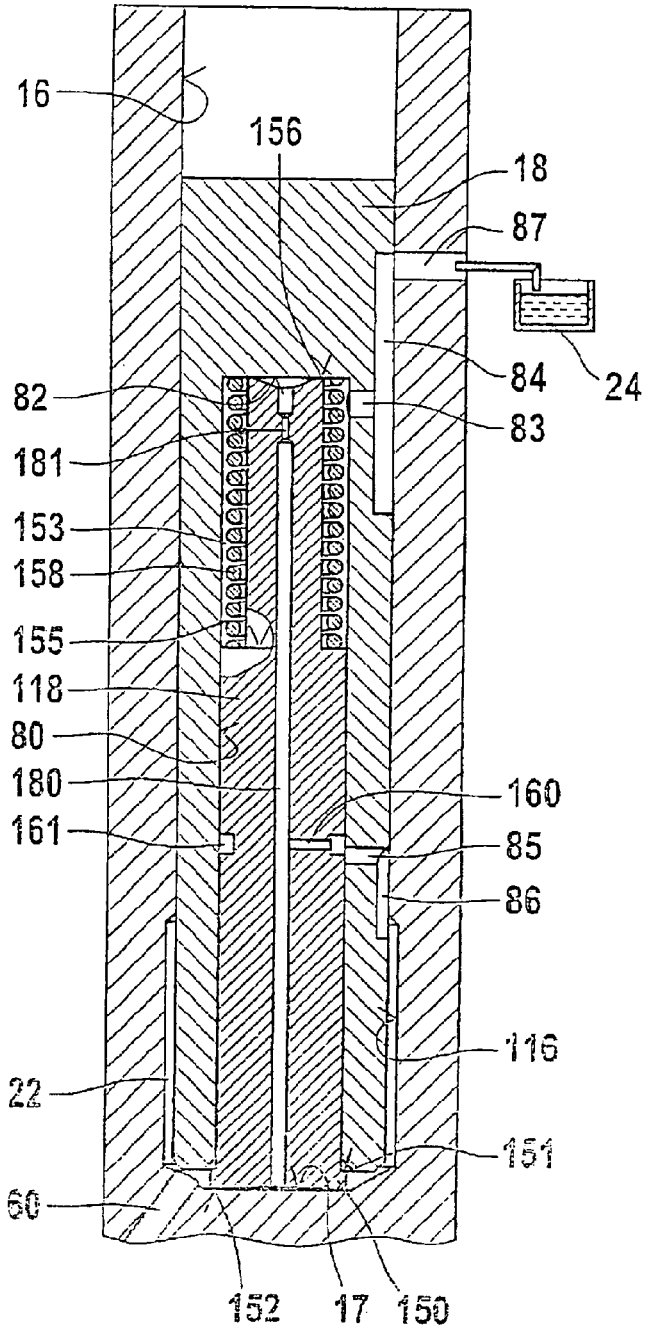
FIG. 5 shows the detail II with the pump pistons when uncoupled from each other, at an inner dead center.

It is also possible for the second pump piston 118 to be optionally placed into a passive position in which it does not execute a delivery stroke and only the first pump piston 18 executes a delivery stroke. This is shown in FIGS. 4 and 5. In its passive position, the second pump piston 118 is disposed with its sealing surface 152 in contact with the extremity 17 of the pump working chamber 22. The through bore 180 in the second pump piston 118 is then disconnected from the pump working chamber 22 by the sealing surface 152. In the event of a leak between the sealing surface 152 and the extremity, a small quantity of fuel can flow out of the pump working chamber 22 via the through bore 180 into the chamber 153 and into the low-pressure region, but the throttle restriction 181 limits this flow. During the intake stroke, only the first pump piston 18 moves from the inner dead center into the outer dead center according to FIG. 4, while the second pump piston 118 remains in its passive position. Via the annular shoulder 151 of the second pump piston 118, the pressure prevailing in the pump working chamber 22 exerts a compressive force on the second pump piston 118 in the direction of the extremity 17. In addition, the spring 158 and the force generated by the low pressure prevailing in the chamber 153 press the second pump piston 118 against the extremity 17. During the intake stroke of the first pump piston 18, the spring 158 relaxes. During the delivery stroke of the first pump piston 18, only its annular end surface contributes to the production of pressure so that a maximal pressure produced in the pump working chamber 22 is correspondingly lower than that produced when the pump pistons 18, 118 are coupled to each other. FIG. 5 shows the pump pistons 18, 118 in the inner dead center position.

The second pump piston 118 is placed into its passive position during the intake stroke as a function of operating parameters of the engine, in particular the engine speed. If the second pump piston 118 is to be placed into its passive position, then the control unit 72 closes the first control valve 68 at a certain time and for a certain duration during the intake stroke, thus interrupting the connection of the pump working chamber 22 to the fuel-supply pump 23 so that fuel cannot flow into the pump working chamber 22. The first pump piston 18, induced by the return spring 19, moves from the inner dead center toward the outer dead center as a function of the shape of the cam 20. This increases the volume of the pump working chamber 22 and since fuel cannot flow into it, the pressure in the pump working chamber 22 falls below the delivery pressure of the fuel-supply pump 23. Consequently, the end surface of the second pump piston 118 in the pump working chamber 22 is only subjected to a low pressure, which exerts a force on the second pump piston 118 in the direction off of the first pump piston 18 that is weaker than the counteracting force, which is equal to the sum of the force of the spring 158 and the force exerted by the low pressure prevailing in the chamber 153. The second pump piston 118 therefore moves inward until its sealing surface 152 comes into contact with the extremity 17 of the pump working chamber 22.

Then the control unit 72 opens the first control valve 68 again so that the pressure in the pump working chamber 22 increases once more. When the second pump piston 118 is disposed in its passive position, the pressure in the pump working chamber 22 does in fact act on this second pump piston 118, not on its end surface, in the direction toward the first pump piston 18, but on the annular shoulder 151 of the second pump piston 118 and therefore in the direction of the extremity 17, exerting a compressive force on the second pump piston 118 in the direction of the extremity 17. The first pump piston 18 executes an intake stroke until reaching the outer dead center and then executes a delivery stroke until reaching the inner dead center. When the first pump piston 18 reaches the region of the inner dead center, then the through bore 180 of the second pump piston 118 is connected to the pump working chamber 22 via the lateral bore 160, the annular groove 161, the lateral bore 85, and the longitudinal groove 86 in the first pump piston 18, which is inserted into the section 116 of the cylinder bore 16. The pressure in the pump working chamber 22 then acts on the end surface of the second pump piston 118 oriented toward the extremity 17 so that the sealing surface 152 of the second pump piston 118 lifts up from the extremity 17. In the subsequent intake stroke, through the closing of the first control valve 68, the second pump piston 118 can once again be placed into its passive position or, if the first control valve 68 remains continuously open, the second pump piston 118 can follow along with the intake stroke of the first pump piston 18 so that the two pump pistons 18, 118 remain coupled to each other.

As the speed of the engine increases, the speed at which the pump pistons 18, 118 move during the intake stroke and the delivery stroke likewise increases. If the fuel-supply pump 23 delivers an approximately constant delivery pressure, then during the intake stroke of the pump pistons 18, 118, due to the increasing speed of the pump pistons 18, 118 that increases with the engine speed, a pressure drop in the pump working chamber 22 that increases with the engine speed occurs in relation to the delivery pressure nominally produced by the fuel-supply pump 23 since the pump working chamber 22 cannot be filled with fuel rapidly enough. The first pump piston 18, induced by the return spring 19, executes its intake stroke in accordance with the profile of the cam 20. If the pressure in the pump working chamber 22 drops sharply, then the second pump piston 118 can no longer follow the intake stroke of the first pump piston 18 since only a weak force acts on it in the direction of the first pump piston 18 that is weaker than the counteracting force, which is equal to the sum of the force of the spring 158 and the force exerted by the low pressure prevailing in the chamber 153. The second pump piston 118 therefore moves toward the extremity 17 and comes to rest with its sealing surface 152 against the extremity 17, thus assuming its passive position. It is consequently also possible to assure that the second pump piston 118 is disposed in its passive position when a predetermined limit speed is reached or exceeded, at which speed the pressure in the pump working chamber 22 drops to a sufficiently sharp degree during the intake stroke. Preferably, however, in the vicinity of the limit speed, the first control valve 68 is closed during the intake stroke as explained above in order to assure that the second pump piston 118 is disposed in its passive position. At a speed that is significantly higher than the limit speed, it is no longer necessary to close the first control valve 68 because it is then assured that the second control piston 118 is disposed in its passive position as a result of the pressure drop in the pump working chamber 22.

It is possible for the two pump pistons 18, 118 to be coupled to each other and execute a delivery stroke up to a predetermined limit speed. In this case, a high pressure can be produced in the pump working chamber 22 even at low engine speeds. When the predetermined limit speed is reached or exceeded, the second pump piston 118 is brought into its passive position as described above so that only the first pump piston 18 executes a delivery stroke, thus reducing the pressure in the pump working chamber 22. This makes it possible to limit the maximal pressure in the pump working chamber 22 and therefore the mechanical load on the components of the fuel injection apparatus. The limit speed after which the second pump piston 118 should be disposed in its passive position can be fixed or can be varied as a function of other operating parameters of the engine. It is also possible for the second pump piston 118 to be placed into its passive position as a function of operating parameters of the engine, in particular the load. In this connection, it is possible, for example, for the two pump pistons 18, 118 to be coupled and execute a delivery stroke together at a high load, while at a low load, the second pump piston 118 is disposed in its passive position and only the first pump piston 18 executes a delivery stroke. The fuel injection therefore occurs with a lower pressure at a low load than at a high load. The speed of the first pump piston 18 during the intake stroke is determined by the shape of the cam 20 in the region in which the intake stroke of the first pump piston 18 occurs. By varying the shape of the cam 20 in this region, it is consequently possible to change the speed of the first pump piston 18 during the intake stroke, thus changing the pressure drop in the pump working chamber 22 and consequently also the limit speed after which the second pump piston 118 is placed into its passive position. The pressure produced by the fuel-supply pump 23 also determines the limit speed after which the second pump piston 118 is placed into its passive position. The higher the pressure produced by the fuel-supply pump 23, the higher the limit speed. It is possible for the pressure produced by the fuel-supply pump 23 to be variable in order to permit a variation of the limit speed.

Figure 6:
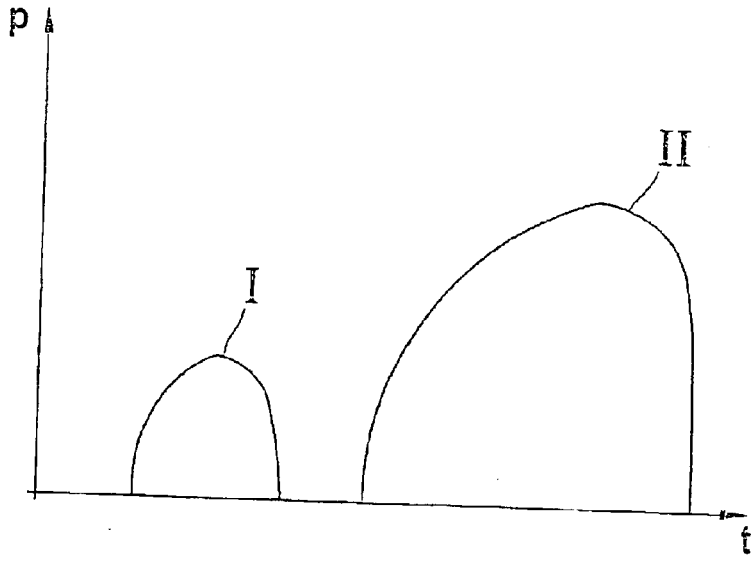
FIG. 6 shows a curve of the pressure at injection openings of a fuel injection valve of the fuel injection apparatus over time.

The remaining function of the fuel injection apparatus will be explained below. FIG. 6 shows the curve of the pressure p at the injection openings 32 of the fuel injection valve 12 over time t during an injection cycle. During the intake stroke of the pump piston 18, it is supplied with fuel from the fuel tank 24. During the delivery stroke of the pump pistons 18, 118, the fuel injection begins with a preinjection, in which the control unit 72 closes the first control valve 68, thus disconnecting the pump working chamber 22 from the relief chamber 24. The control unit 72 also opens the second control valve 70 so that the control pressure chamber 52 is connected to the relief chamber 24. In this instance, high pressure cannot build up in the control pressure chamber 52 since its pressure is relieved in the direction of the relief chamber 24. However, a small quantity of fuel can flow out of the pump working chamber 22 to the relief chamber 24 via the throttle restrictions 63 and 65 so that the full high pressure that would build up if the second control valve 70 were closed cannot build up in the pump working chamber 22. If the pressure in the pump working chamber 22 and therefore in the pressure chamber 40 of the fuel injection valve 12 is great enough for the compressive force that it exerts on the injection valve element 28 via the pressure shoulder 42 to exceed the sum of the force of the closing spring 44 and the compressive force exerted on the control piston 50 by the residual pressure prevailing in the control pressure chamber 52, then the injection valve element 28 moves in the opening direction 29 and opens the at least one injection opening 32. In order to terminate the preinjection, the control unit closes the second control valve 70 so that the control pressure chamber 52 is disconnected from the relief chamber 24. The first control valve 68 remains in its closed position. As a result, the same high pressure as in the pump working chamber 22 builds up in the control pressure chamber 52 so that a powerful compressive force acts on the control piston 50 in the closing direction. Since the force acting on the injection valve element 28 in the opening direction 29 is now less than the sum of the force of the closing spring 44 and the compressive force on the control piston 50, the fuel injection valve 12 closes. The preinjection corresponds to an injection phase labeled I in FIG. 6.

For a subsequent main injection that corresponds to an injection phase labeled II in FIG. 6, the control unit 72 opens the second control valve 70 so that the pressure in the control pressure chamber 52 decreases. The fuel injection valve 12 then opens due to the reduced compressive force on the control piston 50, and the injection valve element 28 travels for its maximal opening stroke. When the second control valve 70 is open, a small quantity of fuel flows out via the throttle restrictions 63, 65 to the relief chamber 24, but the throttle restrictions 63, 65 can be embodied with a small flow cross section, thus minimizing the quantity of fuel flowing out and the reduction of the pressure in the pump working chamber 22.

In order to terminate the main injection, the control unit 72 brings the first control valve 68 into its open switched position so that the pump working chamber 22 is connected to the relief chamber 24 and only a slight compressive force continues to act on the injection valve element 28 in the opening direction 29; the fuel injection valve 12 closes due to the force of the closing spring 44 and the force exerted on the control piston 50 by the residual pressure prevailing in the control pressure chamber 52. The second control valve 70 can be in either its open position or its closed position upon termination of the main injection.

The triggering of the two control valves 68, 70 by the control unit 72 in order to execute the fuel injection requires that the control unit 72 contain information as to whether both of the pump pistons 18, 118 are executing a delivery stroke or only the first pump piston 18 is executing a delivery stroke, since this changes the pressure of the fuel injection. In the transition from the joint delivery stroke of the two pump pistons 18, 118 executed when they are coupled to each other, to the delivery stroke executed by only the first pump piston 18, the pressure produced in the pump working chamber 22 decreases sharply from one delivery stroke to the next so that the times and in particular, the durations that the control unit 72 triggers the control valves 68, 70 must be correspondingly corrected in order to assure a continuity of the fuel quantity injected and a proper functioning of the engine.

It is also possible to eliminate the control piston 50, the control pressure chamber 52, and the second control valve 70 that controls the connection of this control pressure chamber to the relief chamber. The fuel injection is then controlled solely by means of first control valve 68, which is closed for the injection of fuel so that the pump working chamber 22 is disconnected from the relief chamber 24, and is opened in order to interrupt or terminate the injection of fuel so that the pressure of the pump working chamber 22 is relieved in the direction of the relief chamber 24. When two injection valve elements 28 are provided, as explained above, then during the preinjection and/or at a low load and/or at a low speed of the engine, only the injection valve element 28 is opened, thus opening the at least one first injection opening, whereas during the main injection and/or at a high load and/or at a high speed of the engine, both of the injection valve elements 28 are opened, thus opening the at least one first injection opening 32 and the at least one second injection opening. It is also possible for the fuel injection valve 12 to have only one injection valve element 28 that controls the at least one injection opening 32.

The foregoing relates to preferred exemplary embodiments of the invention, it being understood that other variants and embodiments thereof are possible within the spirit and scope of the invention, the latter being defined by the appended claims.

What is claimed is:

1. A fuel injection apparatus for an internal combustion engine, comprising a high-pressure fuel pump (10) and a fuel injection valve (12) connected to it for each cylinder of the engine, the high-pressure fuel pump (10) having at least one pump piston (18) that is driven into a stroke motion by the engine and delimiting a pump working chamber (22), which is supplied with fuel from a fuel tank (24), the fuel injection valve (12) having a pressure chamber (40) connected to the pump working chamber (22) and at least one injection valve element (28) that controls at least one injection opening (32), the pressure prevailing in the pressure chamber (40) acting on the at least one injection valve element (28) in an opening direction (29) counter to a closing force in order to open the at least one injection opening (32), a control valve (68) that at least indirectly controls a connection (66) of the pump working chamber (22) to a relief chamber (24) and a pressure source (23) in order to fill the pump working chamber (22) during the intake stroke of the at least one pump piston (18), the high-pressure fuel pump (10) having two pump pistons (18, 118) including a first pump piston (18) inside of which a second pump piston (118) is guided so that it can slide in an approximately coaxial fashion, wherein the two pump pistons (18, 118) delimit the pump working chamber (22), in that the first pump piston (18) is driven in a stroke motion, and means optionally coupling the two pump pistons (18, 118) to each other to move together as a unit during the delivery stroke, or decoupling the two pump pistons (18, 118) whereby the second pump piston (118) can be fixed in a passive position so that only the first pump piston (18) executes the delivery stroke.

2. The fuel injection apparatus according to claim 1, wherein in its passive position, the second pump piston (118) is disposed with one end contacting an extremity (17) of the pump working chamber (22) in the region of an inner dead center of the stroke motion of the pump pistons (18, 118), which is where the pump pistons (18, 118) are disposed at the end of a delivery stroke and at the beginning of an intake stroke.

3. The fuel injection apparatus according to claim 1, wherein the first pump piston (18) comprises a blind bore (80) that opens on its end surface that delimits the pump working chamber (22), the second pump piston (118) being guided in a sliding fashion inside this blind bore.

4. The fuel injection apparatus according to claim 2, wherein the first pump piston (18) comprises a blind bore (80) that opens on its end surface that delimits the pump working chamber (22), the second pump piston (118) being guided in a sliding fashion inside this blind bore.

5. The fuel injection apparatus according to claim 3, wherein inside the blind bore (80), the second pump piston (118) delimits a chamber (153) that is connected to a low-pressure region.

6. The fuel injection apparatus according to claim 4, wherein inside the blind bore (80), the second pump piston (118) delimits a chamber (153) that is connected to a low-pressure region.

7. The fuel injection apparatus according to claim 3, wherein, when the two pump pistons (18, 118) are coupled to each other, the second pump piston (118) resting with one end against the bottom (82) of the blind bore (80) of the first pump piston (18).

8. The fuel injection apparatus according to claim 4, wherein, when the two pump pistons (18, 118) are coupled to each other, the second pump piston (118) resting with one end against the bottom (82) of the blind bore (80) of the first pump piston (18).

9. The fuel injection apparatus according to claim 5, wherein the second pump piston (118) comprises a through conduit (180) that can connect the pump working chamber (22) to the chamber (153) and that is provided with at least one throttle restriction (181) in the through conduit (180).

10. The fuel injection apparatus according to claim 7, wherein the second pump piston (118) comprises a through conduit (180) that can connect the pump working chamber (22) to the chamber (153) and that is provided with at least one throttle restriction (181) in the through conduit (180).

11. The fuel injection apparatus according to claim 7, wherein the second pump piston (118) comprises a through conduit (180) that can connect the pump working chamber (22) to the chamber (153) and that is provided with at least one throttle restriction (181) in the through conduit (180), and further comprising a sealing surface (156) at the end of the second pump piston (118) oriented toward the bottom (82) of the blind bore (80), the sealing surface (156) closing the mouth of the through conduit (180) to the chamber (153) when the sealing surface (156) of the second pump piston (118) rests against the bottom (82) of the blind bore (80), thereby disconnecting the chamber (153) from the through conduit (180).

12. The fuel injection apparatus according to claim 3, comprising a spring (158) clamped between the first pump piston (18) and the second pump piston (118), the spring (158) pushing the second pump piston (118) outwardly of the blind bore (80).

13. The fuel injection apparatus according to claim 5, comprising a spring (158) clamped between the first pump piston (18) and the second pump piston (118), the spring (158) pushing the second pump piston (118) outwardly of the blind bore (80).

14. The fuel injection apparatus to claim 7, comprising a spring (158) clamped between the first pump piston (18) and the second pump piston (118), the spring (158) pushing the second pump piston (118) outwardly of the blind bore (80).

15. The fuel injection apparatus according to claim 12, wherein the spring (158) is clamped between the bottom (82) of the blind bore (80) and an annular shoulder (155) on the second pump piston (118), which shoulder is formed by a cross sectional reduction of this second pump piston.

16. The fuel injection apparatus according to claim 2, wherein the second pump piston (118) comprises a through conduit (180) that can connect the pump working chamber (22) to the chamber (153) and that is provided with at least one throttle restriction (181) in the through conduit (180) and further comprising a sealing surface (152) at the end of the second pump piston (118) oriented toward the extremity (17) of the pump working chamber (22), which sealing surface closes the mouth of the through conduit (180) to the pump working chamber (22) when the sealing surface (152) of the second pump piston (118) rests against the extremity (17) of the pump working chamber (22), thereby disconnecting the pump working chamber (22) from the through conduit (180).

17. The fuel injection apparatus according to claim 9, wherein the through conduit (180) of the second pump piston (118) has a connection (85, 86, 160, 161) to the pump working chamber (22) that is controlled by the first pump piston (18), wherein when the first pump piston (18) is disposed in the region of its inner dead center, the through conduit (180) is connected to the pump working chamber (22), and wherein when the first pump piston (18) is disposed outside the region of its inner dead center, the through conduit (180) is disconnected from the pump working chamber (22).

18. The fuel injection apparatus according to claim 2, wherein the second pump piston (118) comprises an annular surface (151) oriented away from and close to the end with which it comes into contact with the extremity (17) of the pump working chamber (22), the annular surface (151) being acted on by the pressure prevailing in the pump working chamber (22), thereby generating a force on the second pump piston (118) in the direction of the extremity (17).

19. The fuel injection apparatus according to claim 1, wherein the control valve (68) is closed during the intake stroke of the pump pistons (18, 118), in order to place the second pump piston (118) into its passive position, thus interrupting the connection of the pump working chamber (22) to the pressure source (23) so that a pressure drop occurs in the pump working chamber (22), which results in the second pump piston (118) being uncoupled from the first pump piston (18), and characterized in that the control valve (68) is subsequently opened again during the intake stroke so that the second pump piston (118) is placed into its passive position by the pressure prevailing in the pump working chamber (22).

20. The fuel injection apparatus according to claim 1, wherein, during the intake stroke of the pump pistons (18, 118), a pressure drop occurs in the pump working chamber (22) that intensifies as the speed of the engine increases, and wherein when a predetermined limit speed is reached or exceeded, the pressure in the pump working chamber (22) drops so sharply that as a result, the second pump piston (118) is uncoupled from the first pump piston (18) and is placed into its passive position.

* * * * *